US005347784A

United States Patent [19]

Crick et al.

[11] Patent Number: 5,347,784

[45] Date of Patent: Sep. 20, 1994

[54] DECORATIVE WALL COVERING WITH IMPROVED INTERLOCK AND CORNER CONSTRUCTION

[75] Inventors: Dallas M. Crick, Pembroke Pines; Alfred Moliere, Miami, both of Fla.

[73] Assignee: Nailite International, Miami, Fla.

[21] Appl. No.: 997,586

[22] Filed: Dec. 28, 1992

[51] Int. Cl.[5] ..... E04D 1/34

[52] U.S. Cl. ..... 52/520; 52/535; 52/546; 52/314

[58] Field of Search ..... 52/520, 521, 533, 543, 52/546, 553, 554, 555, 535, 314

[56] References Cited

U.S. PATENT DOCUMENTS

| | | | |
|---|---|---|---|
| 3,304,676 | 2/1967 | Sallie et al. | 52/555 |
| 4,015,391 | 4/1977 | Epstein et al. | 52/543 |
| 4,223,490 | 9/1980 | Medow | 52/521 |
| 4,522,002 | 6/1985 | Davis et al. | 52/309.11 |
| 4,680,911 | 7/1987 | Davis et al. | 52/521 |
| 5,072,562 | 12/1991 | Crick et al. | 52/533 |
| 5,076,037 | 12/1991 | Crick et al. | 52/520 |

*Primary Examiner*—Carl D. Friedman
*Assistant Examiner*—Kien Nguyen
*Attorney, Agent, or Firm*—Leydig, Voit & Mayer, Ltd.

[57] ABSTRACT

A wall covering comprising a plurality of plastic molded panels each having a relatively thin body portion formed with rows of simulated building elements. The panels are mounted on a support surface in a plurality of horizontal courses with a side marginal edge region of one panel overlapping and sealingly engaging an underlying side marginal edge region of the adjacent panel. The underlying side marginal edge region of each panel is formed with a plurality of laterally extending interlock flanges each having a nailing aperture, and the overlapping side marginal edge region of the adjacent panel has a plurality of integrally formed hooks for engaging an upper peripheral edge of a respective one of the interlock flanges for positively interlocking the overlapping sides and for maintaining sealing engagement therebetween. A corner molding is provided for receiving respective ends of the panels at a corner in a manner which enhances the aesthetic appearance of the finished installation.

26 Claims, 4 Drawing Sheets

FIG. 3
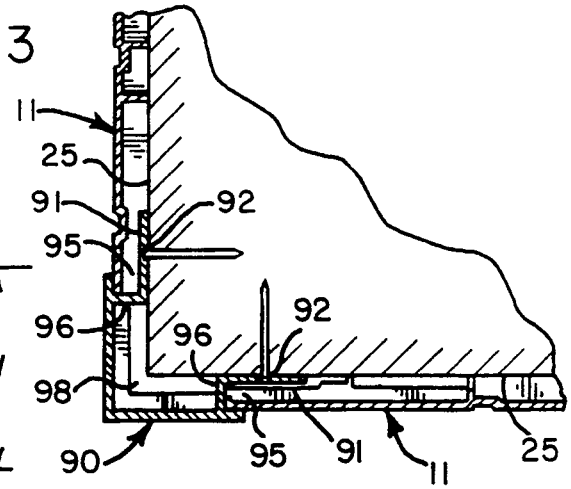
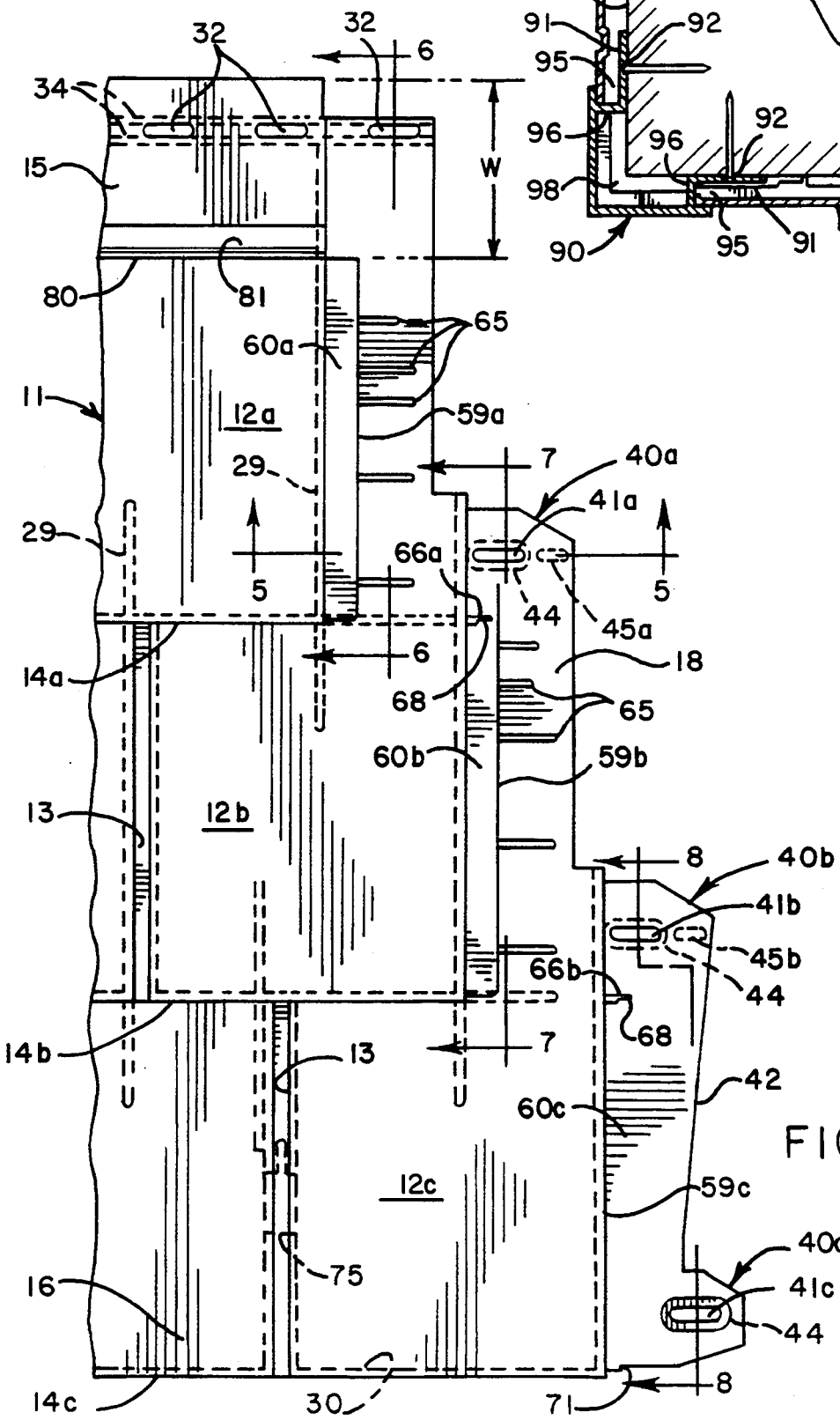
FIG. 4

DECORATIVE WALL COVERING WITH IMPROVED INTERLOCK AND CORNER CONSTRUCTION

FIELD OF THE INVENTION

The present invention relates generally to roof and wall coverings primarily intended for outdoor usage, and more particularly, to roof and wall coverings comprised of relatively large panels which each are molded or otherwise formed with decorative patterns characteristic of conventional roofing and siding materials such as shake, tile, brick or the like.

BACKGROUND OF THE INVENTION

Various synthetic roof and wall coverings are known today, such as those formed of elongated thermoplastic panels that are nailed to the wall or roof support surface in horizontal courses or rows in partially overlapping relation to each other so as to provide a substantially water resistant, protective layer over the support surface. Such panels, which usually are identically molded, commonly are formed with a plurality of rows of simulated building elements, such as shake shingles. Because the panels are identically molded, a panel-to-panel identity can be easily noticed if the panels are not carefully installed. Leakage problems between adjoining panels also can occur.

To facilitate installation, such panels typically are nailed to the wall or support surface along an upper horizontal nailing flange with the lower marginal edge region overlapping the panel in the course immediately below and with one side marginal edge region overlapping the laterally adjacent panel. While various means have been proposed for interlocking the overlapping portions of adjacent panels to provide a water seal therebetween and to minimize the noticeability of the junctions between panels, such interlocks often have been cumbersome to engage during installation and frequently are ineffective in establishing and maintaining sealed engagement of the panels, particularly when the panels are mounted on irregular surfaces or are exposed to extreme weather conditions.

Because such panels are made of plastic and are relatively large in size, usually having a length of 48 inches or more, the panels tend to easily bend and deform during handling and upon mounting on even slightly irregular or rough mounting surfaces, which often occurs when the panels are being used as a replacement covering on an existing wall or roof. Deformation and bending of the panels, either as a result of mounting or because of exposure to the outside elements, can destroy peripheral seals between the panels and detract from the appearance of the covering. Such irregularities are especially noticeable in panels formed with simulated "perfection" shake, which have a relatively uniform appearance. Because of the uniformity in such perfection shake panels, difficulties also have been incurred in forming corners with the wall covering without detracting from the realistic and aesthetic appearance of the installation.

OBJECTS AND SUMMARY OF THE INVENTION

It is an object of the present invention to provide a wall and roof panel that is adapted for more reliable interlocking engagement along its peripheral sides for maintaining a sealed condition between overlapping marginal edge portions of the panels and for enhancing the realistic and aesthetic appearance of the assembled wall covering, even when mounted on slightly irregular support surfaces.

Another object is to provide a synthetic wall and roof panel which permits more secure mounting of the panel on the support surface and easier and more effective interlocking of overlapping side marginal edge regions. A related object is to provide such a panel which enables nailing of the panel to the support surface along top and side marginal edge regions for more secure installation, while not encumbering the interlocking engagement of subsequently installed panels.

A further object is to provide a wall and roof panel of the foregoing type which is relatively simple in construction and which lends itself to economical manufacture and ease of installation.

Yet another object is to provide a more aesthetic and naturally appearing corner construction for synthetic wall and roof panels formed with relatively uniform building elements, such as perfection shake.

Other objects and advantages of the invention will become apparent upon reading the following detailed description and upon reference to the drawings, in which:

BRIEF DESCRIPTION OF THE DRAWINGS

FIG. 3 is an enlarged fragmentary section taken in the plane of line 3—3 in FIG. 1;

FIG. 4 is an enlarged plan view of the face side of a right-hand portion of one of the panels of the illustrated wall covering;

Figure 1:
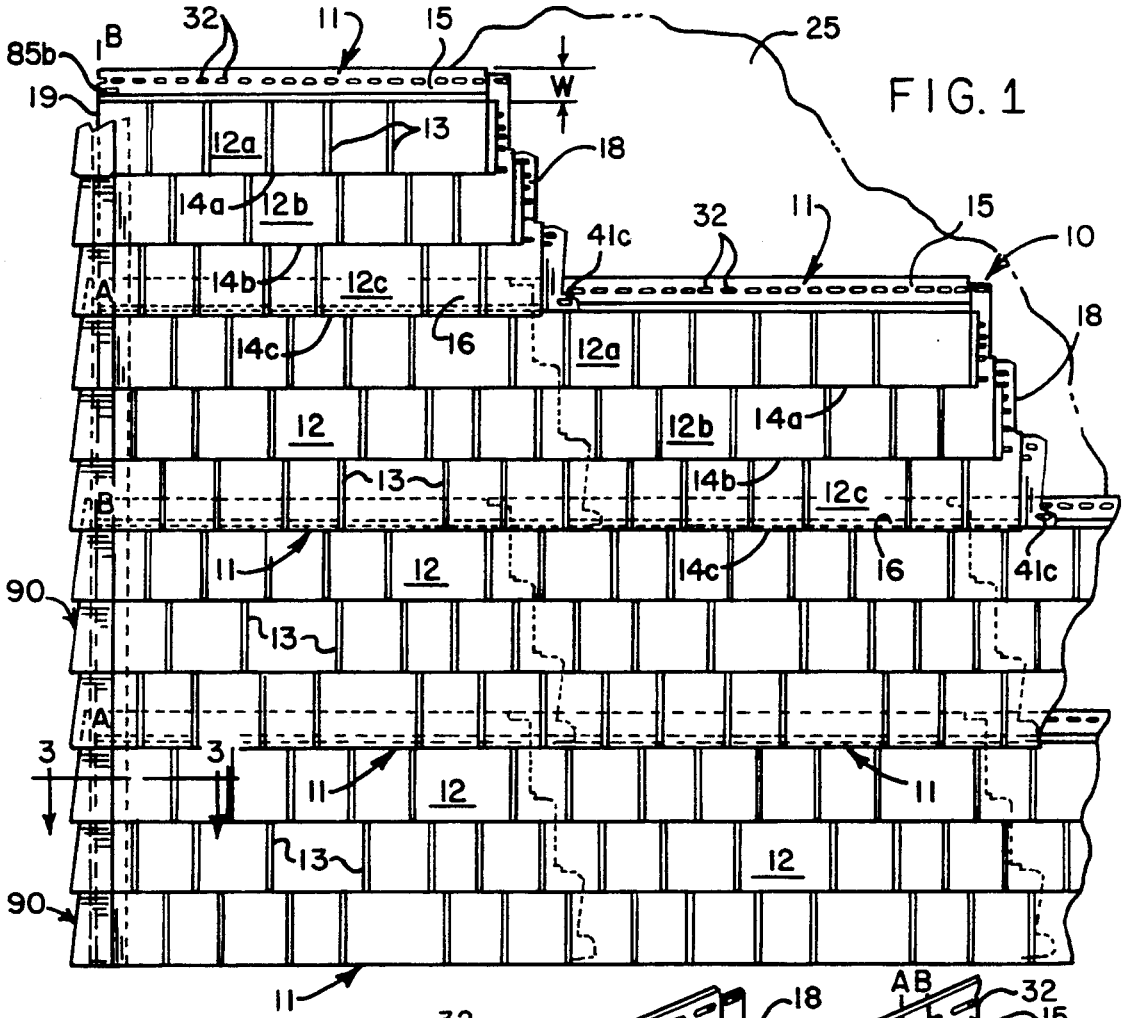
FIG. 1 is a plan view of a wall covering comprising panels and corner moldings in accordance with the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE INVENTION

Referring now more particularly to the drawings, there is shown an illustrative wall covering 10 comprising a plurality of panels 11 each embodying the present invention. The panels 11, which preferably are molded out of relatively thin rigid plastic material, each are formed with simulated building elements. In this instance, the panels 11 are formed with simulated cedar shake 12 of irregular width which are disposed in a plurality of parallel rows 12*a*, 12*b* and 12*c*, with adjacent shake 12 in each row being separated by a small gap 13. The illustrated simulated shake pattern is of a type known in the industry as "perfection" shake, wherein the lower edges 14*a*, 14*b*, 14*c* of the rows 12*a*, 12*b*, 12*c* are in substantially straight line, and except for their width, the individual shake elements are substantially similar in appearance. It will be understood that the panels 11 could be formed with other forms of simulated shake shingles, or other types of building materials, such as tile, brick and the like.

Each panel 11 has an upper horizontal marginal edge region 15 having a substantially uniform width w extending across the top of the panel immediately above the top row 12*a* of shake 12, a lower marginal edge region 16 which defines a lower peripheral edge of the panel, a side marginal edge region 18 located to the right-hand side of the last simulated shake 12 in each row 12*a*, 12*b*, and 12*c*, and a marginal edge region 19 on the opposite side of the panel 11 which defines a left-side peripheral edge immediately adjacent the first simulated shake of each row 12*a*, 12*b*, 12*c*. The panels 11 are mounted on a support surface 25, which may be a wall or roof of a house or other building structure, in horizontal courses with the right-side marginal edge region 18 in underlying relation to the left-side marginal edge region 19 of the panel immediately to the right thereof and with the lower marginal edge region 16 of the panels in each course overlying the upper marginal edge region 15 of the panel in the course immediately below.

To enable mounting of the panels 11 in side-by-side relation with the junctures between adjacent panels less noticeable to the eye, the rows 12*a*, 12*b*, 12*c* of shake 12 of each panel 11 extend in offset relation to each other so as to define stepped left and right-hand sides of the panel. In the illustrated embodiment, the middle row 12*b* of shake extends farther to the right than the first row 12*a* a distance corresponding to about one-quarter to one-half the width of one shake 12, and the bottom row 12*c* extends farther to the right than the middle row 12*b* about a similar distance.

Figures 9, 10, 11, 12:
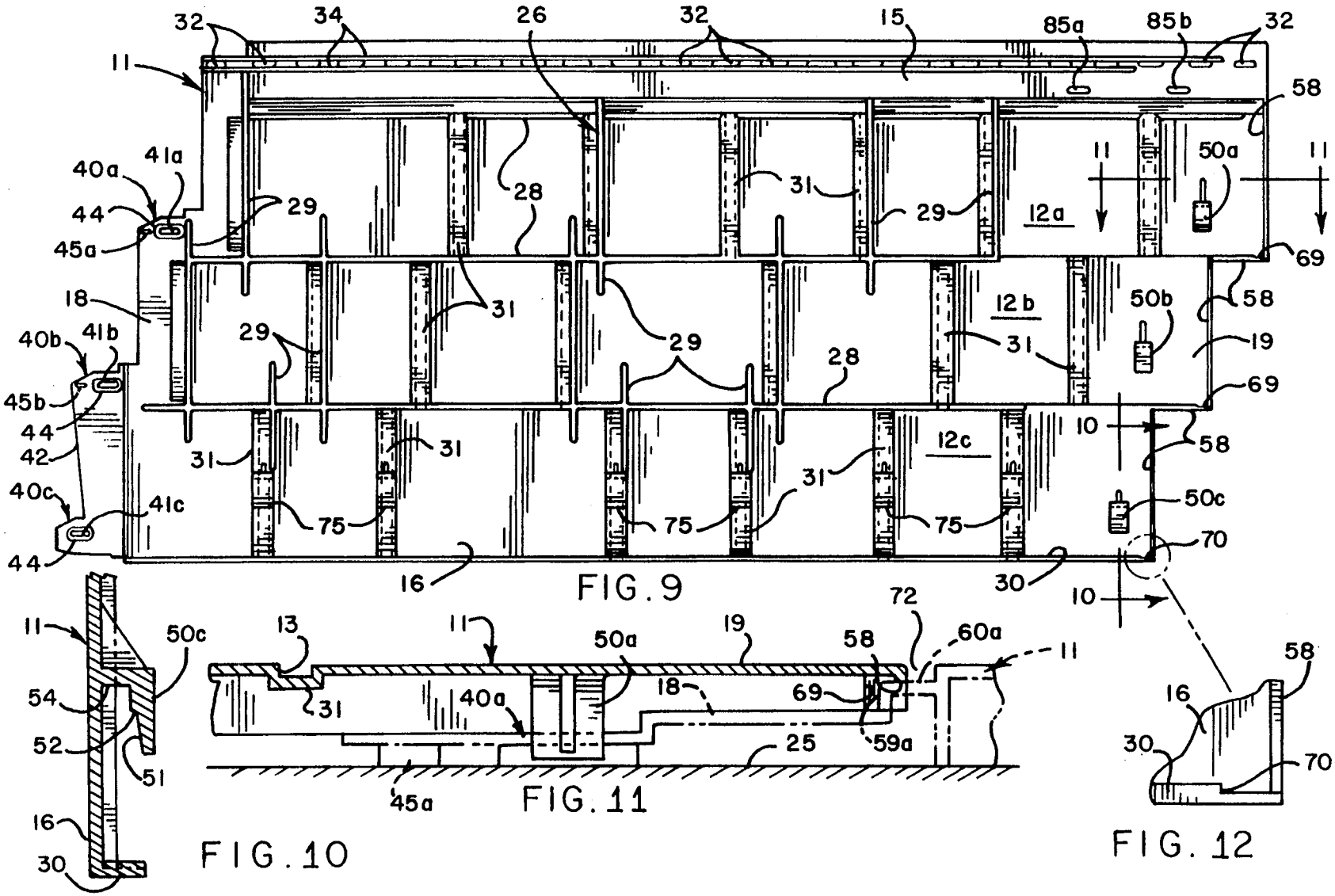
FIG. 9 is a rear side plan view of one of the illustrated panels.
FIGS. 10 and 11 are enlarged fragmentary sections taken in the planes of lines 10—10 and 11—11, respectively, in FIG. 9.
FIG. 12 is an enlarged fragmentary view of a lower rear corner of the panel shown in FIG. 9.

For rigidifying the panels 11 and for providing stable mounting of the panels on the support surface 25, each panel 11 has an integrally formed rectangular grid 26 of reinforcing and support ribs on the underside thereof (FIG. 9). The grid 26 includes a plurality of horizontally extending ribs 28 formed on the underside of the panel 11 adjacent the top and bottom of each row of shake, the lowermost horizontal rib of which defines a bottom sealing flange 30. To complete the grid 26, a plurality of vertically oriented, laterally spaced ribs 29 are formed on the underside of each panel at locations adjacent the sides of some of the shake 12, in this instance, extending rearwardly from ridges 31 defined by the separating gaps 13 between the shake 12. The substantially rectangular grid 26 defined by the horizontal and vertical ribs 28, 29 has been found to enhance the rigidity of the panels 11 so as to resist bending and deformation during handling and upon mounting, thereby facilitating the establishment of reliable seals about the overlapping marginal edge regions of the panels upon mounting.

The panels 11 preferably are mounted beginning with the left-hand panel of the lowermost course to be installed on the wall or roof, as is known in the art. The first panel in each course typically is cut at a different location along a left-hand side thereof in order that the simulated shake 12 of each course are offset with respect to the simulated shake of the panel in the course below so as to enhance the natural appearance of the wall covering. The panels 11 in this instance each have two predetermined cutting lines A, B (FIG. 2) along which the panels alternatively may be cut to start alternate courses as disclosed in U.S. Pat. No. 5,076,037, assigned to the same assignee as the present application.

Figure 6:
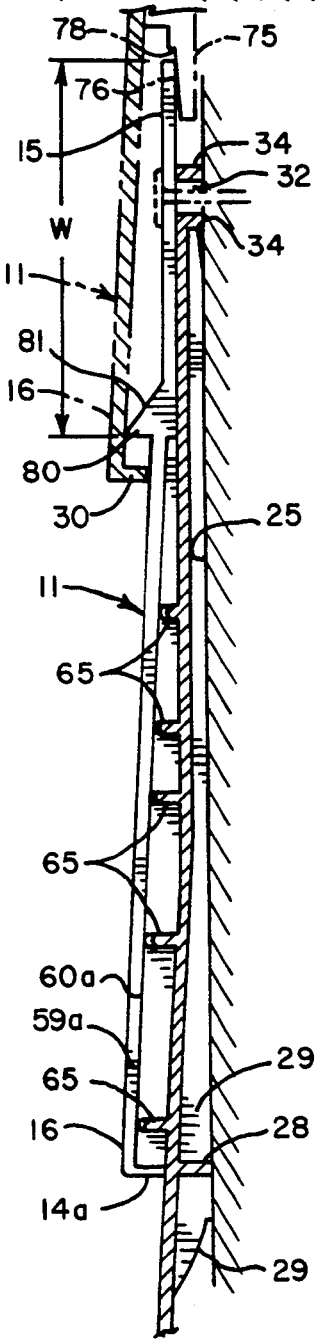
Figure 7:
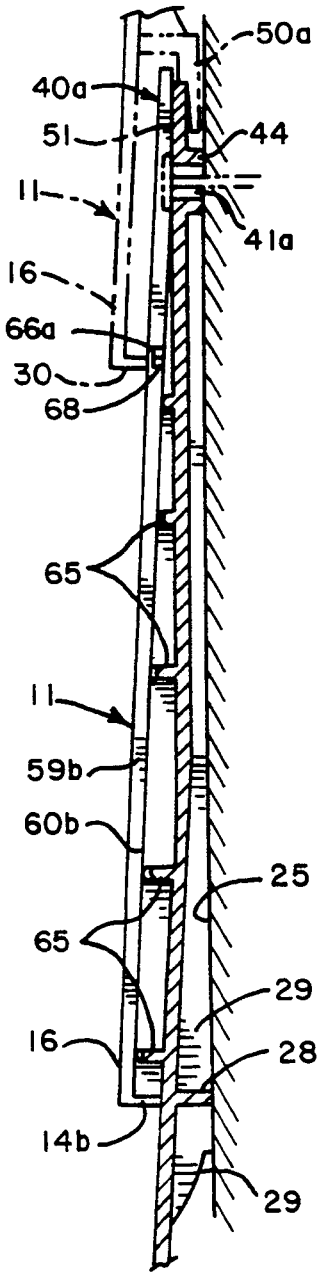

For securing the panels 11 to the support surface 25, the upper marginal edge region 15 of each panel is formed with a row of elongated laterally spaced nailing apertures 32. In order to provide firm support for the panel on the wall during nailing and for establishing a seal between the rear side of the panel 11 and the support surface 25, the upper marginal edge region 15 is formed with a pair of rearwardly extending horizontal sealing flanges 34 which extend substantially the length of the upper marginal edge region 15 on top and bottom sides of the nailing apertures 32 (FIGS. 6 and 9). Once the upper marginal edge region 15 is nailed to the support surface, the horizontal sealing flanges 34 are maintained firmly against the support surface 25 and cannot be lifted from the support surface even during severe weather conditions.

In accordance with the invention, a side marginal edge region of each panel defines a plurality of mounting and interlock flanges, each of which is formed with a respective nailing aperture, for enabling secure and easy interlocking engagement of overlapping side marginal edge regions of the panels during installation. To this end, in the illustrated embodiment, the right-side marginal edge region 18 of each panel 11 has a plurality of mounting and interlock flanges 40*a*, 40*b*, 40*c* which each are formed with a respective nailing aperture 41*a*, 41*b*, 41*c*. One mounting and interlock flange 40*a* in this case is nearly centrally located at the right side of the panel and is formed with a nailing aperture 41*a* at the upper end thereof, a second mounting and interlock flange 40*b* is disposed in laterally stepped relation below and to the right of the first flange 40*a* and is formed with a nailing aperture 41*b* adjacent an upper end thereof, and a third relatively smaller sized mounting and interlock flange 40*c* extends laterally from the bottom of the panel and has a nailing aperture 41*c*. For maximizing the lateral width of the second and third flanges 40*b*, 40*c*, a side edge 42 of the second flange 40*b* is tapered downwardly and laterally to the left, as viewed in FIG. 4.

The nailing apertures 41*a*, 41*b*, 41*c* each have a horizontally-oriented elongated configuration for permitting lateral thermal expansion and contraction of the mounted panel, and the mounting and interlock flanges 40*a*, 40*b*, 40*c* each have an elongated boss 44 integrally formed on the underside thereof in surrounding relation to the respective nailing aperture for supporting the panel during mounting. For providing further stability for the mounting and interlocking flanges 40*a*, 40*b*, 40*c* on the support surface 25, an elongated foot or rib 45*a*, 45*b* is integrally formed on the underside of the flanges 40*a*, 40*b* laterally to the right of the nailing aperture bosses 44. It will be appreciated by one skilled in the art that by nailing the panel 11 to the support surface 25 through the nailing apertures 32, 41*a*, 41*b*, 41*c* along both upper and right-side marginal edge regions 15, 18, the panel 11 may be securely retained on the support surface.

In keeping with the invention, the mounting and interlock flanges 40*a*, 40*b*, 40*c* each are supported in predetermined spaced relation to the support surface 25 by the nail aperture bosses 44 for easy and secure interlocking engagement by hooks 50*a*, 50*b*, 50*c* (see FIGS. 2 and 9) integrally formed on the underside of the overlapping side marginal edge region 19 of the adjacent panel. The hooks 50*a*, 50*b*, 50*c* are formed in downwardly directed fashion on the underside of the left-side marginal edge region 19 of each panel for positive interlocking engagement under the respective upper edge portions of the mounting and interlock flanges 40*a*, 40*b*, 40*c* of the underlying panel. The hooks 50*a*, 50*b*, 50*c* in this case each is formed with a downwardly and rearwardly tapered engagement or ramp surface 51 (FIG. 10) which facilitates positioning of the hook under the mounting and interlock flange of the underlying panel and drawing together of the hooks 50*a*, 50*b*, 50*c* and mounting and interlock flanges 40*a*, 40*b*, 40*c*, and thus the overlapping side marginal edge regions 18, 19 of the panels as the panel in the upper course is moved downwardly into mounted position. It will be appreciated that since the nailing apertures 41*a*, 41*b*, 41*c* and associated support bosses 44 are disposed in close relation to the upper peripheral edges of the mounting and interlock flanges 40*a*, 40*b*, 40*c*, the mounting and interlock flanges define a relatively rigid anchor or retention means for engagement by the hooks 50*a*, 50*b*, 50*c* of the overlying panel.

Figure 8:
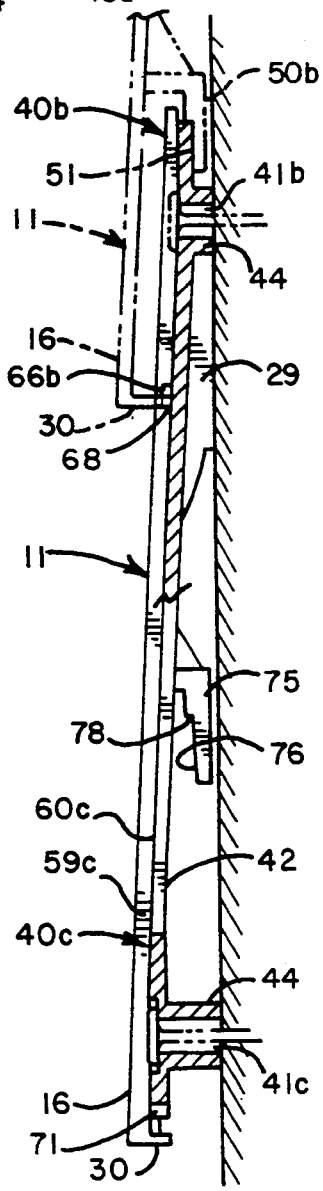

To assist in positioning of the panels 11 of each course in horizontally aligned relation to each other, the tapered ramp surface 51 of each hook 50*a*, 50*b*, 50*c* is formed with a small horizontal locating ledge 52 which serves as a stop or abutment for the upper peripheral edges of the mounting and interlock flanges 40*a*, 40*b*, 40*c* of the underlying panel (FIG. 8). As a result, as the left-hand marginal edge region 19 of a panel is lowered onto the right-side marginal edge region of the previously mounted panel, the tapered ramp surfaces 51 of the hooks 50*a*, 50*b*, 50*c* draw the left-side marginal edge 19 into secure overlapping relation with the right-side marginal edge region 18 of the previously mounted panel until the upper edges of the mounting and interlock flanges 40*a*, 40*b*, 40*c* engage the locating ledges 52 of the tapered ramp surfaces 51 of the hooks.

The hooks 50*a*, 50*b*, 50*c* in this case each define a groove 54 with the underside of the left-side marginal edge region 19 which extends upwardly beyond the locating ledge 52 for permitting vertical thermal expansion and contraction between the overlapping side marginal edge regions 18, 19 of the panels following installation. In this regard, the locating ledges 52 have a relatively small height sufficient to provide a positive indication of when proper seating is established between the hooks 50*a*, 50*b*, 50*c* and the respective mounting and interlock flanges 40*a*, 40*b*, 40*c*, but yet which permits the upper edges of the mounting and interlock flanges 40*a*, 40*b*, 40*c* to move past the locating ledges 52 and further into the grooves 54 during relative expansion between the panels.

For forming a seal between the overlapping side marginal edge regions 18, 19 of adjacent panels 11, the left-side peripheral edge of each panel is formed with a vertically and laterally stepped rearwardly directed sealing flange 58 adapted for bearing engagement with the right-hand marginal edge region 18 of the previously mounted panel. In this instance, a platform 59*a* extending laterally to the right of the last shake 12 in the first row 12*a* defines a first sealing surface 60*a*, and a platform 59*b* adjacent the last shake in the second row 12*b* defines a second side sealing surface 60*b*. The second and third mounting and interlock flanges 40*b*, 40*c* are coplanar and define a third side platform 59*c* and sealing surface 60*c* adjacent the end of the lower row 12*c* of simulated shake as shown in FIG. 4. The rearwardly directed sealing flange 58 of the overlapping side marginal edge region 19 is positionable onto the sealing surfaces 60*a*, 60*b*, 60*c* and is maintained thereon by positive interlocking engagement between the hooks 50*a*, 50*b*, 50*c* and the mounting and interlocking flanges 40*a*, 40*b*, 40*c*.

To facilitate positioning of the sealing flange 58 onto the surfaces 60*a*, 60*b*, a plurality of tapered rib-like ramps 65 (FIG. 4) extend between the respective platforms 59*a*, 59*b* and the adjacent lower level surfaces of the right-hand marginal edge region 18. In the unlikely event that the side sealing flange 58 should move off of the sealing surfaces 60*a*, 60*b* defined by the platforms 59*a*, 59*b* during extreme contraction, the ramps 65 serve to guide movement back onto the platform when normal conditions return. To prevent an unsightly gap between the stepped side sealing flange 58 and the side of the last shake in the second and third rows 12*b*, 12*c* during lateral contraction of the panels, small lateral flanges 66*a*, 66*b* extend outwardly from the last shake 12 of the second and third rows 12*b*, 12*c*, respectively, in substantially aligned relation to the lower peripheral edge of the first and second rows 12*a*, 12*b* of shake.

Figure 5:
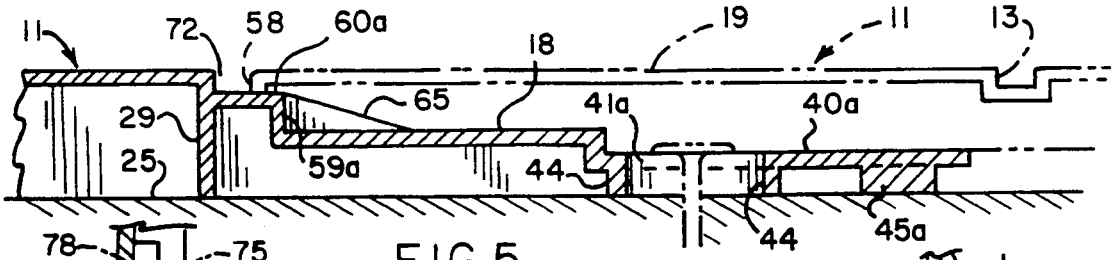
FIGS. 5–8 are enlarged fragmentary sections taken in the planes of lines 5—5, 6—6, 7—7, and 8—8, respectively, in FIG. 4.

To assist in positioning the first shake of each panel in proper laterally spaced relation to the last shake of the previously mounted panel, the flanges 66*a*, 66*b* are formed with locating notches 68 for receiving similar locating ledges 69 at the stepped corners of the side sealing flange 58. The bottom sealing flange 30 is formed with a similar locating notch 70 for engagement with a locating ledge 71 formed on the bottom periphery of the lower mounting and interlock flange 40*c* (FIGS. 4, 9, and 12). A spacing or gap 72 between the shake of adjacent panels 11 preferably should correspond substantially to that of the fixed gaps 13 between shake 12 formed in the panels (FIGS. 5 and 11). Preferably the fixed gaps 13 between shake 12 are of various widths, such as in the range of between ¼ inch and 5/16 inch, in order that the variance in the gap 72 between the last shake of each panel and the first shake of the adjacent panel caused by thermal expansion is substantially undetectable.

Upon completing installation of one course of panels across the support surface 25, as indicated above, a second course is similarly nailed to the support surface, with the lower marginal edge regions 16 of the panels of that course overlying the upper marginal edge regions 15 of the panels in the course immediately below. For interlocking the lower marginal edge region 16 of each panel to the upper marginal edge region 15 of the previously mounted panel, the underside of each panel has a plurality of laterally spaced, downwardly directed hooks 75, similar to the hooks 50*a*, 50*b*, 50*c*, for engaging the upper peripheral edge of the panel in the course below. The hooks 75 in this instance extend rearwardly from the ridges 31 defined on the underside of the panel by the gaps 13 between the shake 12. Like the hooks 50*a*, 50*b*, 50*c* the hooks 75 have a downwardly and rearwardly tapered ramp surface 76 to facilitate engagement with the upper peripheral edge of the underlying panel, and the ramp surface 76 of each hook 75 is formed with a locating ledge 78 that facilitates predetermined positioning of the panel during mounting, while permitting relative movement between the upper edge of the panel and the hooks 75 during thermal expansion and contraction (FIG. 6).

For establishing seals between the overlapping bottom marginal edge region 16 of one panel and the upper marginal edge region 15 of the panel immediately below, the bottom downwardly-turned sealing-lip 30 of the overlapping panel bears against the face of the upper marginal edge region 15 of the underlying panel. The bottom sealing lip 30 in this instance is positioned over a water barrier ledge 80 formed on the face of the upper marginal edge region 15 of the underlying panel adjacent the upper edges of the top row 12*a* of simulated shake 12. The overlying panel preferably is mounted with the bottom sealing lip 30 positioned with a small space separating the sealing lip 30 from the ledge 80 to accommodate thermal expansion and contraction of the mounted panels. To prevent the downwardly turned peripheral lip 30 of the upper panel from catching on the ledge 80 of the underlying panel during mounting, the upper side of the locating ledge 80 is in the form of an inclined ramp 81 which tends to guide the bottom peripheral lip 30 over the ledge 80 into proper position during installation. The interlocking engagement between the hooks 75 of the overlying panel and the upper edge of the underlying panel retains the sealing lip 30 in engagement with the underlying panel.

For further retaining sealed engagement between the overlapping upper and lower marginal edge regions 15, 16 of the panels, each panel 11 is formed with a pair of auxiliary nailing apertures 85*a*, 85*b* in close proximity to the left side of the upper marginal edge region 15 immediately below the nailing apertures 32. Upon positioning of the lower marginal edge region 16 of one panel onto the underlying panel, the lowermost side nailing aperture 41*c* is positioned into coincident relation with either the auxiliary nailing aperture 85*a* or the auxiliary nailing aperture 85*b*, depending upon whether the course is started along cutting line A or B. Upon nailing the side marginal edge region 18 of the panel to the support surface, the lowermost mounting and interlock flange 40*c* is directly secured to the underlying upper marginal edge region 15 with the nail passing through the lowermost nailing aperture 41*c* and the coincident auxiliary nailing aperture 85*a* or 85*b*.

Figure 2:
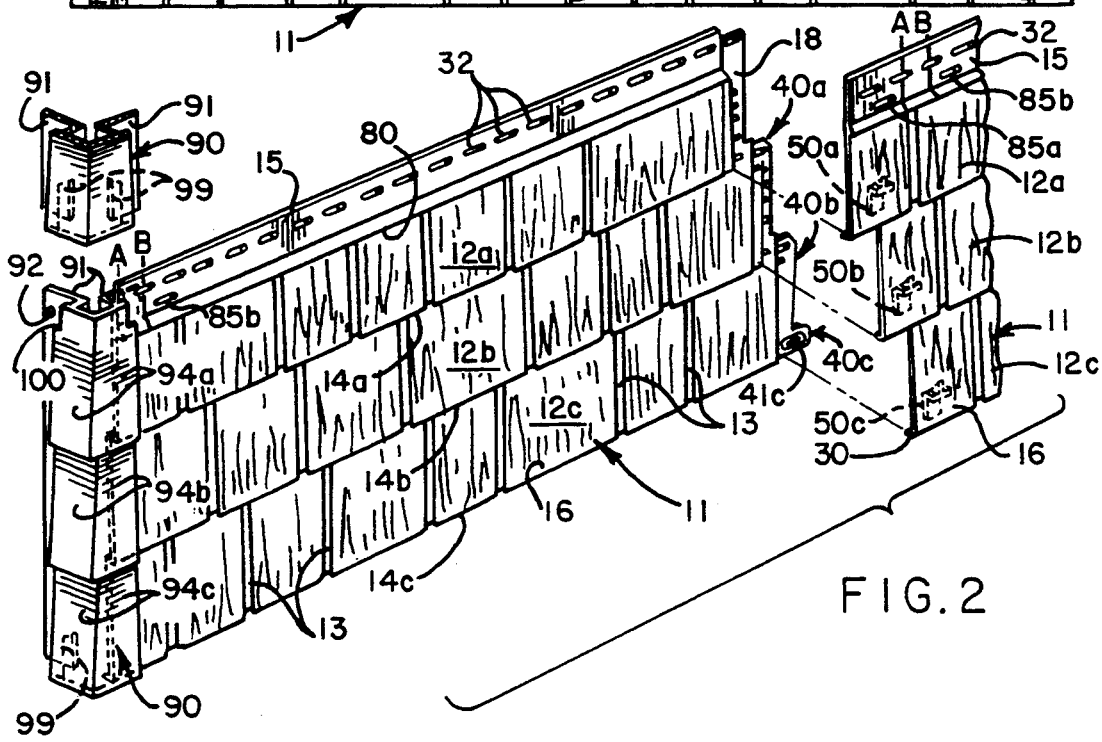
FIG. 2 is an exploded perspective of pairs of panels and corner moldings of the illustrated wall covering.

In carrying out a further aspect of the invention, a corner molding 90 is provided which preserves the natural and aesthetic appearance of the simulated building elements at corners of a wall or building structure. The corner molding 90 in this case includes a pair of mounting flanges 91 extending outwardly of the molding at a right angle to each other (FIGS. 2 and 3). The mounting flanges 91 each are formed with vertically spaced nailing apertures 92 to facilitate nailing of the molding to right angle walls or support surfaces. Each corner molding 90 further is formed with three tiers 94*a*, 94*b*, 94*c* of simulated building elements, in this case "perfection" shake, also formed at a right angle juncture. Each tier 94*a*, 94*b*, 94*c* has an outer surface extending in downward and outwardly tapered fashion, similar to the shake in corresponding first, second and third rows 12*a*, 12*b*, 12*c* of each panel.

For creating a relatively uninterrupted and unnoticeable juncture between the simulated building elements of the corner molding 90 and those of adjacent panels 11, the building element tiers 94*a*, 94*b*, 94*c* of the corner molding 90 and the mounting flanges 91 define an outwardly opening pocket 95 on each side of the molding 90 for receiving an end of a respective panel 11. The end of the panel 11 is appropriately cut along a straight line and positioned within the pocket 95 such that the shake at the end of the first, second and third rows 12*a*, 12*b*, 12*c* of the panel are positioned in close underlying relation to the shake of the first, second and third tiers 94*a*, 94*b*, 94*c* of the corner molding 90. Since the walls of the simulated shake of the corner molding, like the walls of the panel 11, are relatively thin, such as about 3/16 inch, the step between the exposed tapered surfaces of the corner molding and the exposed surface of the underlying simulated shake 12 of the adjoining panel 11 is small and barely noticeable in the finished installation.

In order to encompass the corner of the building structure in a substantially sealed enclosure, each corner molding pocket 95 in the illustrated embodiment is defined by the underside of building element tiers 94*a*, 94*b*, 94,*c*, the mounting flange 91, and an end wall 96, which together define a sealed chamber 98 about the corner (FIG. 3).

To permit the corner moldings 90 to be mounted in partially overlapping relation to each other, consistent with the panels 11, the end walls 96 are formed with a respective upwardly extending notches 99 (FIG. 2) at the lower end thereof which permit positioning of the lower end of one corner molding 90 over the previously mounted corner molding. The mounting flanges 91 are formed with small horizontal locating ledges 100 at their upper ends to facilitate proper positioning of the notches 99 of the corner molding 90 onto the previously mounted corner element.

From the foregoing, it can be seen that the wall covering of the present invention is adapted for secure mounting utilizing nailing apertures along both upper and side marginal edge regions, while still enabling easy and effective interlocking engagement between overlapping marginal edge regions for enhancing a realistic and aesthetic appearance of the wall covering, even when installed on slightly irregular support surfaces. The panels furthermore have a relatively simple construction which lends itself to economical manufacture and ease of installation. The corner moldings further enhance the aesthetic appearance of the finished installation.

What is claimed is:

1. A wall covering for mounting on a support surface comprising a plurality of panels each having a body portion formed with simulated building elements, said panels each having right-side and left-side marginal edge regions, said panels being mountable on said support surface in a plurality of horizontal courses with each of said panels having a side marginal edge region overlapping an underlying side marginal edge region of an adjacent panel, said overlapping and underlying side marginal edge regions defining engageable sealing means therebetween, said underlying side marginal edge region having a plurality of laterally extending interlock flanges disposed in elevated relation to the support surface upon which the panel is mounted, and said overlapping side marginal edge region having integrally formed locking elements depending from an underside thereof for positively engaging an upper peripheral edge portion of a respective one of said interlock flanges for positively interlocking the overlapping side marginal edge region with the underlying side marginal edge region of the adjacent panel and for maintaining said side marginal edge region sealing means in an engaged relation.

2. The wall covering of claim 1 in which each said interlock flange is formed with a nail receiving aperture for nailing and securely retaining the side marginal side region on the support surface.

3. The wall covering of claim 2 in which each said locking element of the overlapping side marginal edge region is engageable with an underside of an interlock flange.

4. The wall covering of claim 3 in which each said interlock flange supporting means is a boss formed on an underside of said underlying side marginal edge region in surrounding relation to the nail receiving aperture of the flange.

5. The wall covering of claim 3 in which each said nail receiving aperture is disposed adjacent an upper peripheral edge of said interlock flange.

6. The wall covering of claim 1 in which said locking elements are downwardly opening hooks.

7. The wall covering of claim 6 in which said hooks each are formed with a locating ledge against which an upper peripheral edge of a respective one of said interlock flanges is positionable for locating adjacent panels in horizontal alignment with each other.

8. The wall covering of claim 7 in which said hooks each have a downwardly and rearwardly tapered engagement surface for engaging an upper periphery of a respective interlock flange, and said locating ledge of each hook is formed on said tapered surface.

9. The wall covering of claim 1 in which said panels each are formed with a plurality of rows of building elements, and said interlock flanges each are located adjacent a respective one of said rows of building elements.

10. The wall covering of claim 9 in which said rows of building elements extend in laterally offset relation to each other to define stepped sides of the panel, and said interlock flanges each are adjacent to a respective row of said building elements in laterally offset relation to each other.

11. The wall covering of claim 10 in which said sealing means includes a stepped rearwardly turned sealing lip adjacent the periphery of said overlying marginal edge region, and said underlying side marginal edge region has a plurality of sealing surfaces disposed at different elevations against which said stepped sealing lip engages.

12. The wall covering of claim 11 in which said sealing surfaces are defined by raised platforms on said underlying side marginal region.

13. The wall covering of claim 12 in which said panels each have tapered ramps extending between a side of said platforms and an adjacent lower surface of said underlying side marginal edge region for guiding movement of said stepped sealing lip onto and off of said platform.

14. The wall covering of claim 1 including means for locating an overlapping side marginal edge region of each panel in position on an underlying side marginal edge region for establishing a predetermined spacing between a last simulated building element in one panel and a first building elements in the adjacent panel.

15. The wall covering of claim 14 in which locating means includes horizontal locating flanges on a face of the underlying side marginal edge region against which the adjacent panel is positionable.

16. The wall covering of claim 15 in which said panels each are formed with a plurality of rows of building elements, and said horizontal locating flanges are located in approximate alignment with the lower edges of at least some of said rows of building elements.

17. The wall covering of claim 1 in which said panels each are formed with a plurality of rows of building elements, one of said interlock flanges being disposed adjacent said first row of building elements, a second of said interlock flanges being disposed adjacent a second row of said building elements in laterally offset relation to said first interlock flange, and a third of said interlock flanges being disposed adjacent a third row of said building elements in laterally offset relation to said second interlock flange.

18. A wall covering for mounting on a support surface comprising a plurality of panels each having a body portion formed with simulated building elements, said panels being mountable on said support surface in a plurality of horizontal courses with each panel having a side marginal edge region overlapping an underlying side marginal edge region of an adjacent panel and a lower marginal edge region overlapping an upper marginal edge region of a panel in the course immediately below, said upper marginal region having means for enabling nailing of the upper marginal edge region to said support surface, said overlapping and underlying side marginal edge regions defining engageable sealing means therebetween, said underlying side marginal edge region having a plurality of laterally extending mounting and interlock flanges disposed in elevated relation to said support surface, said mounting and interlock flanges each being formed with a nail receiving aperture for enabling nailing of the underlying side marginal edge region to the support surface, and said overlapping side marginal edge region having a plurality of integrally formed locking elements depending from an underside thereof for positively engaging an upper peripheral edge portion of a respective one of said interlock flanges for positively interlocking the overlapping side marginal edge region with the underlying side marginal edge region of the adjacent panel and for maintaining said side marginal edge region sealing means in an engaged relation.

19. The wall covering of claim 18 in which said locking elements of the overlapping side marginal edge region each being engageable with an underside of a respective one of said mounting interlock flanges.

20. The wall covering of claim 19 in which said mounting and interlock flange supporting means includes a boss formed on an underside of said underlying side marginal edge region in surrounding relation to each said nail receiving apertures.

21. The wall covering of claim 19 in which each said nail receiving aperture is disposed adjacent an upper peripheral edge of the respective mounting and interlock flange.

22. The wall covering of claim 19 in which said locking elements are downwardly opening hooks.

23. The wall covering of claim 19 in which said panels each are formed with a plurality of rows of building elements, and said interlock flanges each are located adjacent a respective one of said rows of building elements.

24. The wall covering of claim 23 in which said rows of building elements extend in laterally offset relation to each other to define stepped sides of the panel, and said interlock flanges each are adjacent to a respective row of said building elements in laterally offset relation to each other.

25. The wall covering of claim 24 including means for locating an overlapping side marginal edge region of each panel in position on an underlying side marginal edge region for establishing a predetermined spacing between a last simulated building element in one panel and a first building elements in the adjacent panel.

26. The wall covering of claim 18 in which the upper marginal edge region of each panel is formed with a plurality of nailing apertures, and a lowermost side marginal edge region nailing aperture is positioned in coincident relation to a nailing aperture of an underlying upper marginal edge region.

* * * * *